US007255393B2

(12) United States Patent
Flanagan

(10) Patent No.: US 7,255,393 B2
(45) Date of Patent: Aug. 14, 2007

(54) PORTABLE APPARATUS AND SYSTEM FOR SUPPORTING A CHILD IN MULTIPLE POSITIONS

(76) Inventor: Stephen R. Flanagan, 1209 Wildcliff Cir. NE., Suite 100, Atlanta, GA (US) 30329-3474

( * ) Notice: Subject to any disclaimer, the term of this patent is extended or adjusted under 35 U.S.C. 154(b) by 36 days.

(21) Appl. No.: 11/120,645

(22) Filed: May 3, 2005

(65) Prior Publication Data

US 2005/0253432 A1 Nov. 17, 2005

Related U.S. Application Data

(60) Provisional application No. 60/567,666, filed on May 3, 2004.

(51) Int. Cl.

| | |
|---|---|
| ***A47D 13/10*** | (2006.01) |
| ***A63G 9/02*** | (2006.01) |
| ***A63G 13/00*** | (2006.01) |
| ***A63G 13/08*** | (2006.01) |

(52) U.S. Cl. ..... 297/278; 297/273; 297/274; 297/277; 297/DIG. 10; 472/105; 472/135

(58) Field of Classification Search ..... 297/273, 297/274, 276, 277, 278, DIG. 10; 472/105, 472/135

See application file for complete search history.

(56) References Cited

U.S. PATENT DOCUMENTS

| | | | | |
|---|---|---|---|---|
| 285,665 | A * | 9/1883 | Peck | 297/278 |
| 296,775 | A * | 4/1884 | Peck | 297/278 |
| 305,003 | A * | 9/1884 | Howell | 297/278 |
| 2,520,377 | A * | 8/1950 | Schrougham | 297/278 |
| 3,842,450 | A | 10/1974 | Pad | |
| 4,258,446 | A | 3/1981 | McAllister et al. | |
| 4,616,824 | A | 10/1986 | Quinlan, Jr. et al. | |
| 5,095,563 | A | 3/1992 | Miller | |
| 5,097,545 | A | 3/1992 | Hooi | |
| 5,499,949 | A * | 3/1996 | Heubl | 297/274 X |
| 6,027,409 | A | 2/2000 | Favorito et al. | |
| 6,068,566 | A | 5/2000 | Kim | |
| 6,386,986 | B1 | 5/2002 | Sonner et al. | |
| 6,561,915 | B2 * | 5/2003 | Kelly et al. | 297/277 X |
| 6,629,727 | B2 | 10/2003 | Asbach et al. | |
| 6,637,814 | B1 * | 10/2003 | Bellows et al. | 297/137 |
| 6,851,745 | B2 | 2/2005 | Nee Wilkins et al. | |
| 6,857,965 | B2 | 2/2005 | Pook et al. | |
| 6,857,966 | B2 | 2/2005 | Armbruster et al. | |
| 6,877,802 | B2 | 4/2005 | Christensen et al. | |
| 6,896,624 | B2 * | 5/2005 | Longenecker et al. | 297/273 X |
| 2005/0011004 | A1 | 1/2005 | Favorito et al. | |
| 2005/0059502 | A1 | 3/2005 | Greger et al. | |

* cited by examiner

*Primary Examiner*—Rodney B. White
(74) *Attorney, Agent, or Firm*—Gray, Plant, Mooty, Mooty & Bennett, PA; Michael A. Bondi

(57) ABSTRACT

An adjustable infant holder apparatus includes a support structure that has a base support and a head support situated at opposing longitudinal ends and mutually coupled by a longitudinal stabilizer. A seat is adjustable between an inclined lying position and an upright sitting position. The seat has a base end that is suspended from the base support and a head end that is suspended from the head support. Optionally, at least one of the base and head ends is suspended by at least one cable that permits the seat to swing back and forth laterally. Embodiments include a linear actuator that can force the swinging motion.

24 Claims, 12 Drawing Sheets

PORTABLE APPARATUS AND SYSTEM FOR SUPPORTING A CHILD IN MULTIPLE POSITIONS

REFERENCES TO RELATED APPLICATION

This application claims the benefit of U.S. Provisional Application entitled "PORTABLE APPARATUS AND SYSTEM FOR SUPPORTING A CHILD IN MULTIPLE POSITIONS," having Ser. No. 60/567,666, and filed on May 3, 2004, which is incorporated herein by reference in its entirety.

FIELD OF THE INVENTION

The present invention relates to portable infant seats and beds. In particular, the present invention relates to a portable infant holder apparatus having multi-function capabilities.

BACKGROUND OF THE INVENTION

Parents today are particularly concerned about every aspect of their baby's well being, from safety and nutrition to physical fitness, and many such parents are looking for the next generation of products that are safe, convenient, practical and well designed, and which give parents the peace of mind they are demanding. With a concern for economics as well, an infant seat system that can support a variety of baby activities, including sleeping, sitting, feeding, soothing, entertainment, and development, which is also compact and portable, would meet these needs in a way not yet satisfied by existing products.

A typical household with an infant tends to have numerous specialized apparatus for cradling, supporting, or otherwise holding the baby in a variety of positions for the various activities. For example, small cribs or bassinets are common for naps. Bouncer-type sling chairs are common items for supporting babies in seated positions for interacting, soothing, feeding, and other generally upright activities. Motorized swings are common for soothing and entertaining infants. These types of devices often include a synthesized music generator offering a limited selection of built-in tunes.

Variations of such examples include simple hammock-type infant holders, which can function as seats, swings, and places for sleeping. Many of these example conventional apparatus include some form of positional adjustment. For example, it is common for dedicated seats and swings to have a reclining seat back to accommodate crossover activities such as sitting or swinging to sleeping. Nevertheless, these adjustments do not achieve an adequate conversion from one type of holder apparatus to another. Thus, a plurality of dedicated apparatus is often utilized by households, at a substantial cost in purchase price and floor space.

Despite all the prior efforts, no one has yet developed an infant holder system that is convertible from one mode of use to another so that the benefits of the product are not sacrificed to cost and a single system can accomplish multi-purpose use for the family. Thus, it would be desirable to address these, and other issues associated with the prior art by providing a compact, portable, and economical multi-function infant holder apparatus.

SUMMARY OF THE INVENTION

The present invention relates to an infant holder apparatus and system that in its most simple embodiment provides an inclined bed with rocking capabilities that is convertible to a seat for placing the infant in an upright position. According to one aspect of the invention, an infant holder apparatus includes a support structure that has a base support and a head support situated at opposing longitudinal ends and mutually coupled by a longitudinal stabilizer. A seat is adjustable between an inclined lying position and an upright sitting position. The seat has a base end that is suspended from the base support and a head end that is suspended from the head support. At least one of the base end and the head end is suspended by at least one cable that permits the seat to swing back and forth laterally.

According to another aspect, an infant holder apparatus includes a support structure that has a base support and a head support situated at opposing longitudinal ends and mutually coupled by a longitudinal stabilizer. The seat has a base end suspended from the base support and a head end suspended from the head support. The seat is adjustable between an inclined lying position and an upright sitting position, and at least one of the base and head supports includes a joint adapted to pivot between a first fixed position and a second fixed position corresponding to the inclined lying position and the upright sitting position, respectively.

In another aspect, the invention is directed to an infant holder apparatus that has a base that includes a first support and a second support situated along a first axis at opposing longitudinal ends. A seat having a first end is coupled to the first support and a second end is coupled to the second support. A swing system that includes a linear actuator is configured to facilitate lateral swinging of the seat. The linear actuator includes a stator electromagnetically coupled with a slider and situated to apply force in at least one direction that is generally perpendicular to the first axis.

The above summary of the present invention is not intended to describe each illustrated embodiment or every implementation of the present invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
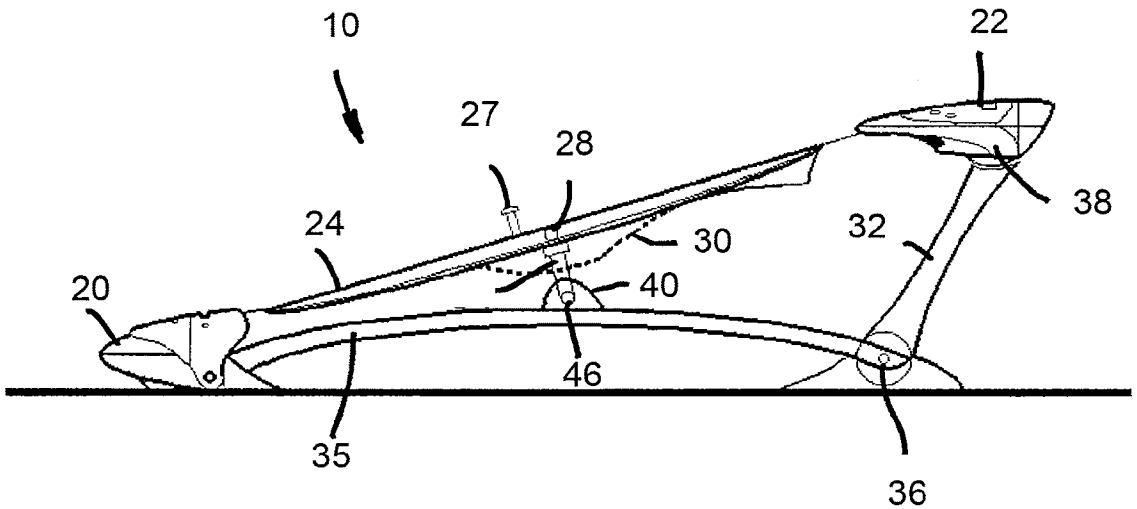
FIG. 1 is an example embodiment of a side view of the infant holder apparatus and system in accordance with one embodiment of the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

The invention is generally directed to an apparatus and a system for facilitating the care of an infant by providing a sturdy sleeping and seating arrangement in a collapsible and portable form factor. While the invention is not necessarily limited to such an application, the invention will be better appreciated using a discussion of example embodiments in such a specific context.

The present invention can be understood by reference to FIGS. 1-13. Referring now to FIG. 1, there is shown an example embodiment of a side view of the infant holder apparatus 10 and system in accordance with the invention. Holder 10 may be collapsible for ease of travel and may be fully integrated to avoid misplacement or loss of components. The holder 10 may be lightweight and designed with washable components, such as a Nylon-Lycra elastic fabric bed, for easy clean up.

Figure 2:
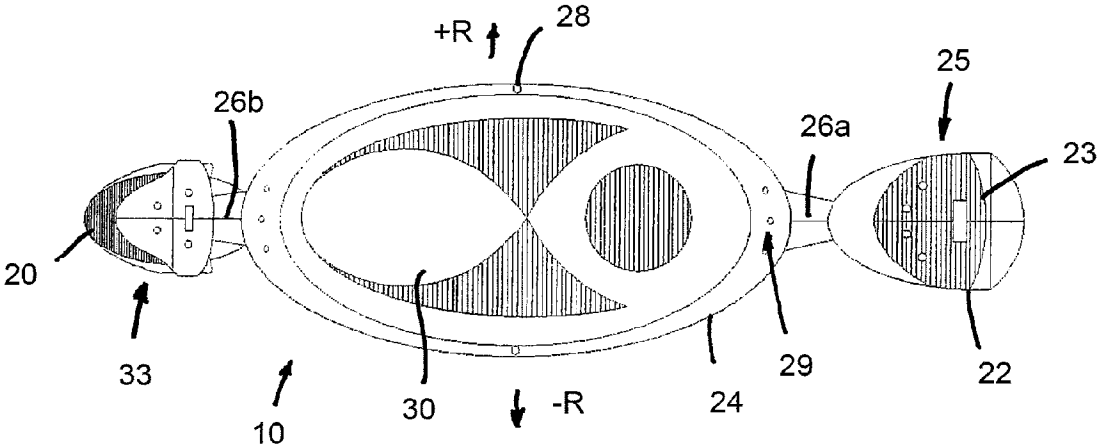
FIG. 2 is a top view of the infant holder apparatus of FIG. 1.
Figures 3, 4:
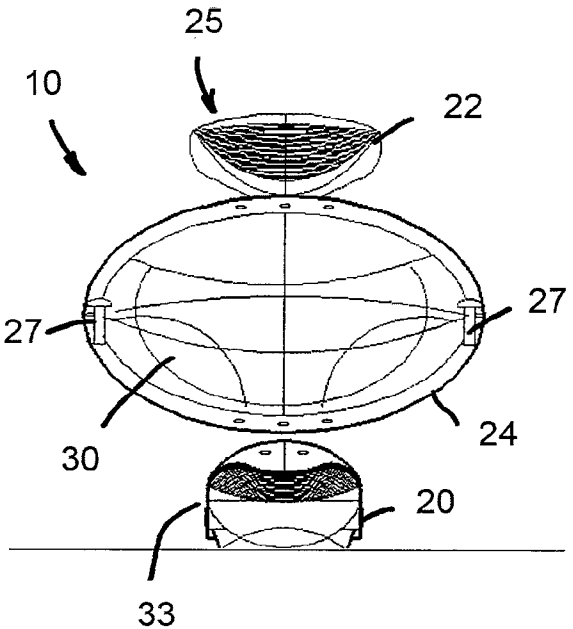
FIG. 3 is a front view of the infant holder apparatus of FIG. 1.
FIG. 4 is a rear view of the infant holder apparatus of FIG. 1.
Figure 5:
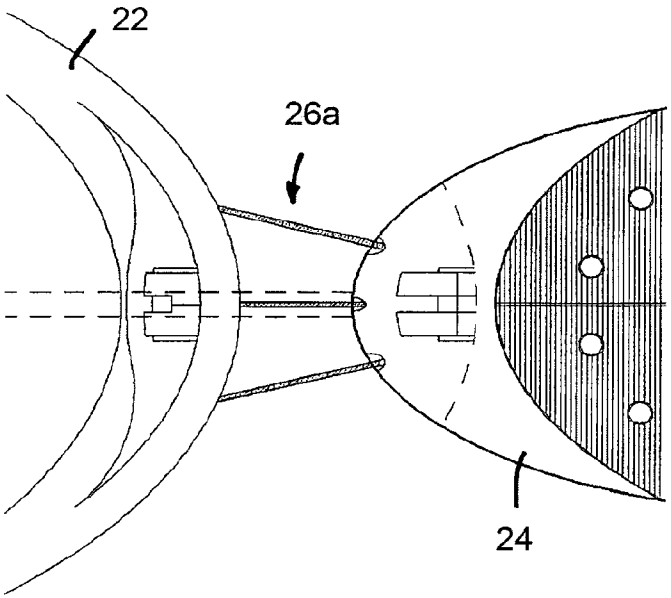
FIG. 5 is a top view of an interconnection between the head support unit and the seat frame.

Referring now to FIGS. 2-4, which illustrate top, front and rear views of the infant holder apparatus, the various components of holder system 10 will be described. In one embodiment, holder apparatus 10 is comprised of a base support unit 20 and a head support unit 22 that support a seat frame 24 via flexible cable-like structures 26*a* and 26*b* such as can be fabricated from Nylon.

Holder 10 further includes a hinge point 28 that permits transition of the seat frame 24 from a lying position to a seated position for the infant. Seat frame 24 may be locked into position with clip lock 29. In a related embodiment, holder 10 further includes additional components to facilitate infant care such as a sound system 25 that includes a CD or MP3 player, an audio amplifier, and speakers integral to either the head or base support to allow parents to choose the music or sounds for the infant's listening.

Also, in a related embodiment, a microphone and wireless transmitter 33 for remote monitoring of the infant is provided in the head support 22 or base support 20. Optionally, one or more teethers 27, which are teething devices can be provided, as well as a display 23 (such as LED or LCD), a bed cover 30 for the seat frame made of Nylon-Lycra. In various adjustable configurations, holder 10 provides the functions of a rocker, hammock, swing and cradle as well as a seat for placing infant in an upright position for feeding or entertainment.

In one example embodiment, the seat frame cover 30 may be a web made of Nylon/Lycra, or other suitable material having elastic properties and that facilitates cleaning, and provides comfort for the infant. Seat frame 24 in this embodiment is of an elliptical design, but is configurable to other designs that accommodate the comfort of the infant and allows for hinging of the frame such that the infant transitions easily from positions of lying and sitting.

By being positioned on an incline according to one embodiment, the seat can provide positive health benefits for infants by maintaining an orientation of the infant to reduce the incidence of reflux, promote positive drainage, and reduce the risk of painful sinus pressure on infant ear canals.

Additional components to holder 10 include a longitudinal stabilizer 35 that couples the head and base units 20, 22, a support arm 32 that supports head unit 22 in an upright position, a lateral stabilizer support 34 and lateral stabilizer 46 for stabilizing the seat frame, a base rotating hinge joint 36 and an upper rotating hinge joint 38 to facilitate movement of the head unit from a lying position of the infant to a seated position, and a swing mechanism 40 to facilitate side to side rocking of the infant in holder 10. For ease of collapsibility and disassembly, holder 10 includes a quick release thru-bolt 42.

Referring now to FIGS. 5-9, these figures illustrate the various components of one embodiment of the infant holder and their modes of operation. In the reclined position, the flexible cords 26*a* hold the seat frame 24 suspended from base support unit 22, supporting the weight of the infant while allowing for a lateral rocking motion, indicated at +R and −R, to soothe the infant. In one embodiment, the range of motion for the swinging seat is governed by the separation between seat frame 24 and the head and base supports 20, 22. In one embodiment, cables 26*a* and 26*b* are each a set of three independent cables tied to both the seat frame 24 and supports 20, 22 at each end of the infant holder 10.

Figure 6:
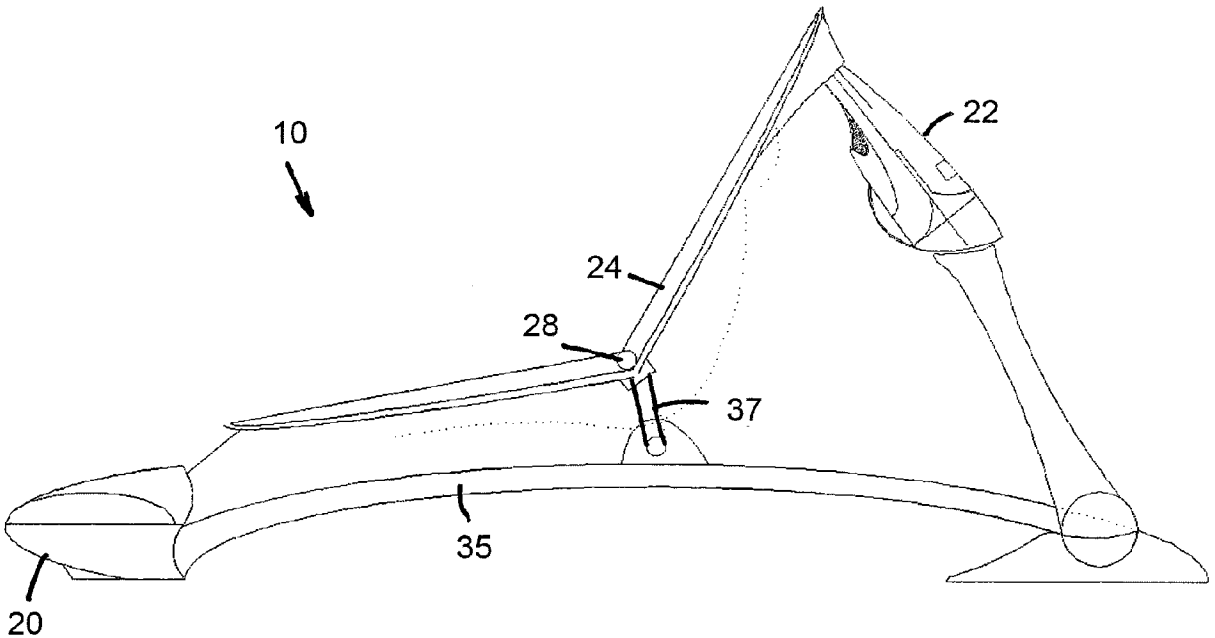
FIG. 6 is a side view of the infant holder in an upright position.

Cables 26*a*, 26*b* can be made from double twisted nylon cores wrapped in a polyester sheath, or another suitable construction known to persons skilled in the art. Cables 26*a*, 26*b* allow seat frame 24 to freely but safely swing side-to-side. In one embodiment, when the seat is in the upright position, as illustrated in FIG. 6, seat frame 24 clips into one or both supports 20, 22 (FIG. 6 illustrates only support 22 engaging seat frame 24), stabilizing the seat from any undesired motion.

Figure 7:
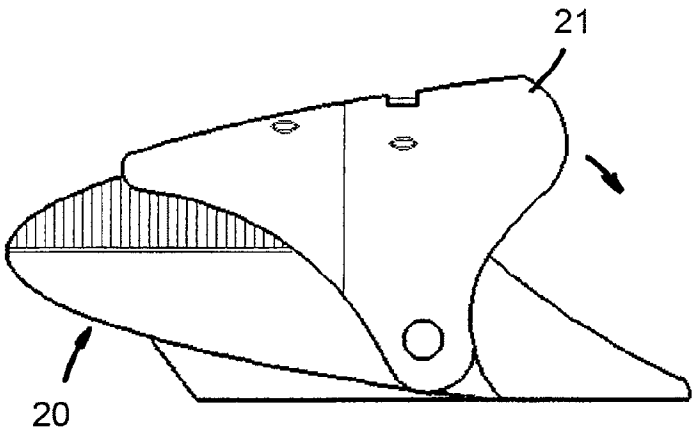
FIG. 7 is a side view of a base support unit.

FIG. 7 illustrates one embodiment of base support 20, in which is included a clip 21 that can be pivoted clockwise as illustrated to engage and lock into place seat frame 24. In a related embodiment, a locking mechanism 37 that is part of swing mechanism 40 includes a lock feature that magnetically or physically retains the seat in a fixed position such that the seat is secured to the longitudinal stabilizer near hinge 28.

Figure 8:
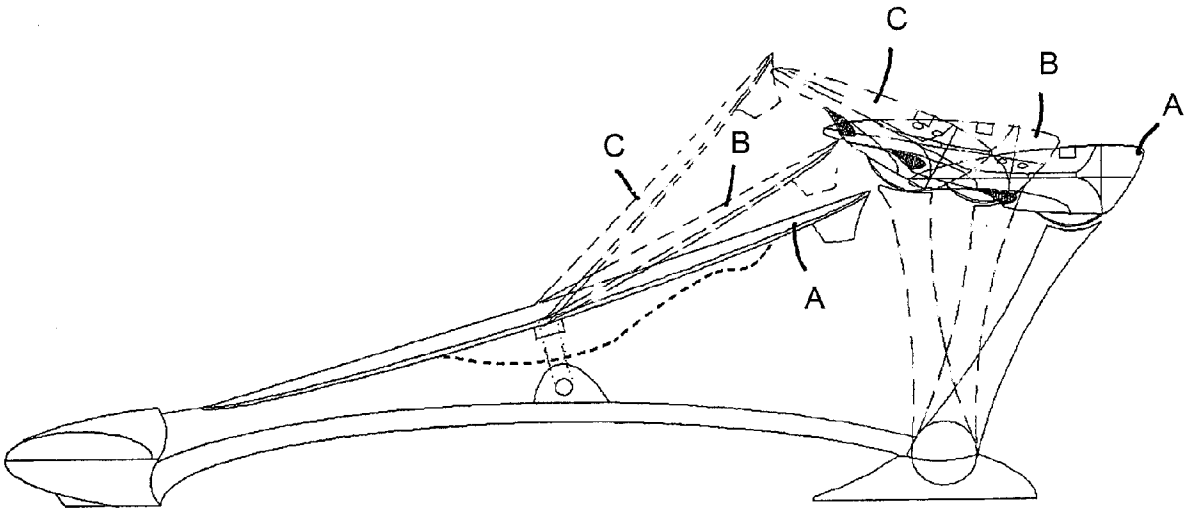
FIG. 8 is a side view of the infant holder in upright, intermediate and lying positions.

The support arm 32 is connected to the base and head support in a double articulating motion that allows the holder to transition from the reclined position to the seated position and then back. The support arm is locked into each position and provides a manual release for changing positions. FIG. 8 illustrates a set of superimposed diagrams representing three example reclining positions of the seat.

In position A, the seat is in its maximally reclined position. In position B, the seat is in an intermediate position. In position C, the seat is in its minimally reclined, or upright, position. In one embodiment, each of the positions A, B, and C, is locked into place by a seat frame reclining mechanism in head support unit 22. In a related embodiment, the seat frame locking mechanism latches into certain locations along the travel path of head support unit 22.

Figure 9:
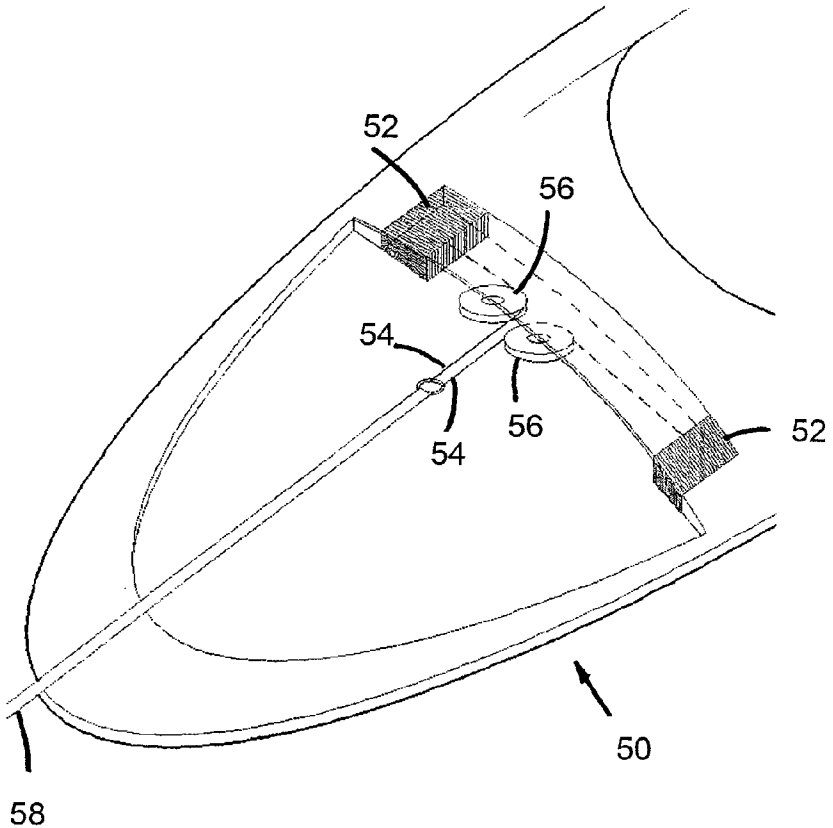
FIG. 9 is a perspective view of an unlocking mechanism in the seat frame.

FIG. 9 illustrates a user-operable unlocking mechanism 50 situated on the underside of the seat 24. Mechanism 50 includes release handles 52, which are each connected to a cable 54 which, in turn, is connected via pulleys 56 to a strap 58 that runs to the locking mechanism in head support unit 22. Strap 58 and cables 54 are under tension due to a spring bias provided by the locking mechanism. When the user squeezes handles 52, the locking mechanism is released, further biasing the spring of the locking mechanism.

In an example operation, beginning at fully-reclined position A, the user grasps the release handles 52 underneath the seat frame 24 and while depressing both release handles 52 pulls the seat frame's upper portion towards the user, thus enabling the hinge joints to facilitate in this motion. The rear support arm 32 will tilt forward and the head support unit 22 begins to rotate forward and upwards until it locks into position. Once the release handles are released, the seat frame 24 remains in the upright, seated position C.

Figure 10:
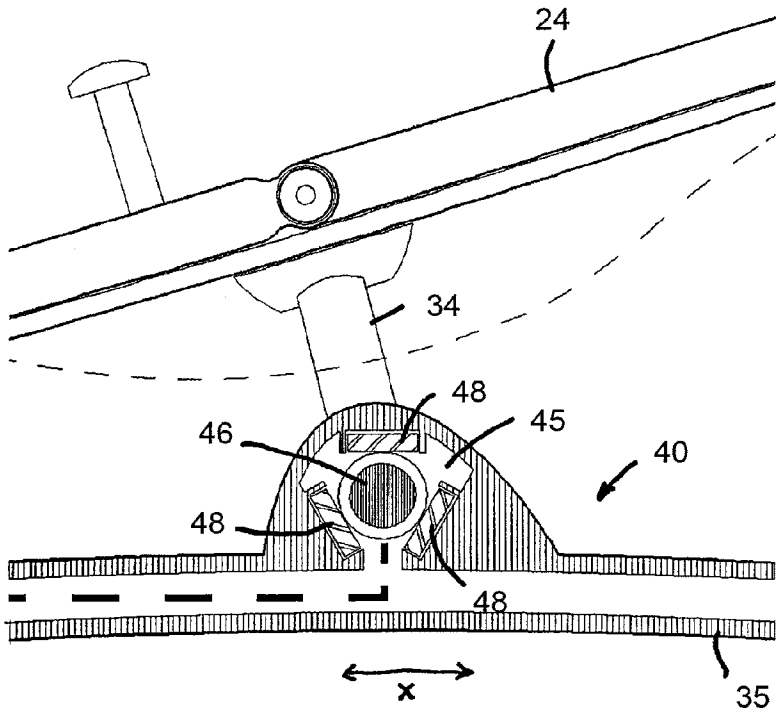
FIG. 10 is a side view of the swing mechanism according to one embodiment of the infant holder.

FIG. 10 illustrates swing mechanism 40, which initiates and maintains the swinging motion. In one type of embodiment, swing mechanism 40 includes linear actuator 45 positioned to push and pull the seat laterally, along a trajectory that is generally perpendicular to reference axis x, along which longitudinal stabilizer 35 and supports 20, 22 are situated. As illustrated in FIG. 10, linear actuator 45 includes a lateral stabilizer 46 in the form of a magnetic rod positioned transversely with respect to longitudinal stabilizer 35.

The stabilizer rod 46 is shaped in an arc that has a curvature that matches the swinging seat's trajectory at the location of stabilizer rod 46. Stabilizer rod 46 is fixed to seat frame 24 via lateral stabilizer support 34. Partially circumscribing stabilizer rod 46 are electrically driven magnets 48 secured to longitudinal support 35. Thus, the arrangement of the presently described embodiment is a linear actuator or linear motor having a stator at the support frame of the infant holder, and an actuated slider at the moving seat that is electromagnetically coupled with the stator. Persons skilled in the art will recognize that the respective positions of the slider and stator can be reversed without departing from the spirit of the invention.

As magnets 48 are energized via signal 49, a force is applied to stabilizer rod 46 that is sufficient to push or pull the seat in a direction corresponding to the signal 49. In one embodiment, the linear actuator 45 of swing mechanism 40 pushes the seat in only one direction when energized. When de-energized, the swing 10 naturally oscillates according to its resonance. In another embodiment, the linear actuator 45 is driven in both directions, thereby permitting greater control over the swinging motion. For example, by applying additive or subtractive forces in relation to the movement of the swinging seat, the amplitude, velocity, and frequency of the movement can be amplified or attenuated in a controlled manner.

Figure 11:
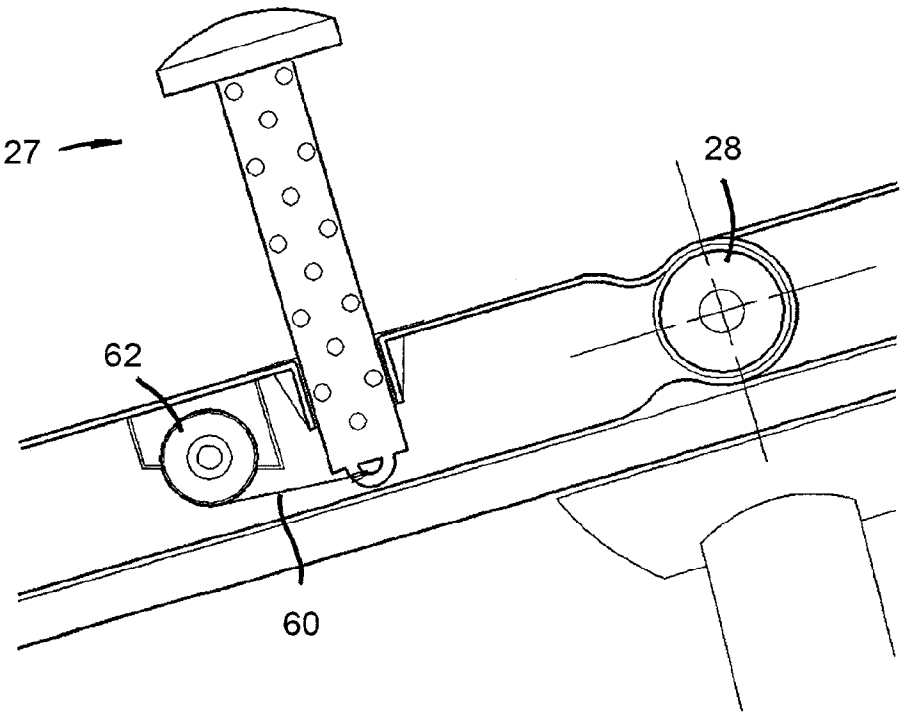
FIG. 11 is an enlarged view of teether attachment mechanism.
Figure 12:
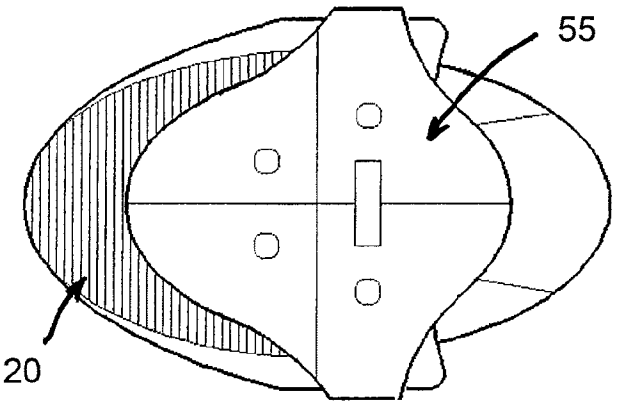
FIG. 12 is a top view of the base support unit.
Figure 13:
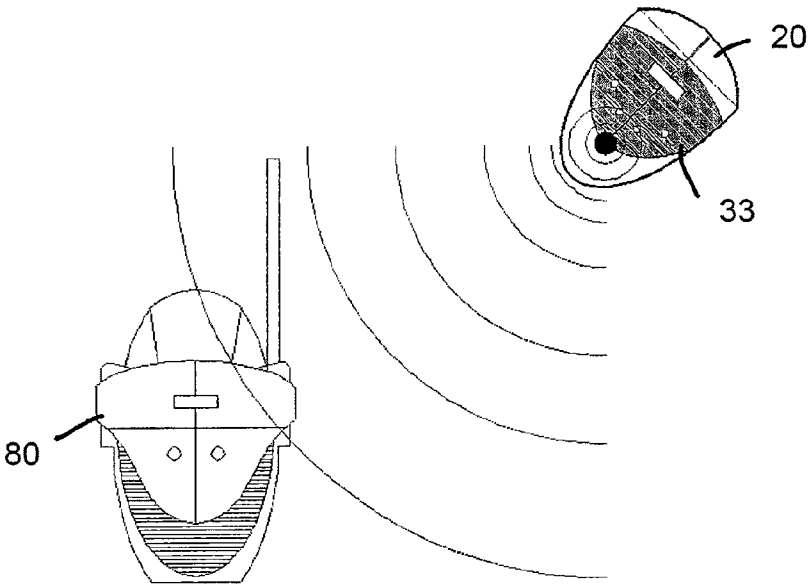
FIG. 13 is an illustration of communication between the base support unit and a portable receiver.

FIGS. 11-13 illustrate various additional features of the infant holder apparatus and system of the present disclosure. FIG. 11 illustrates teether 27 in detail. Adjacent to hinge point 28 of the infant holder 10 is teether 27 tied to the underside of the seat's frame 24. Connected by a retractable cord 60, the teether 27 may have a cylindrical shape and may be coated in a soft, textured polymer suitable for infant use.

With the cord held under constant but exceedingly low level tension by recoil assembly 62, the teether will automatically return to its holder allowing it to always remain within reach of the child. At about 3 inches in length, the teether 27 is adapted to be easy to grasp by infants and to promote development their motor skills.

FIG. 12 illustrates base support unit 20 in detail. In one embodiment, base support unit 20 includes control panel 55 for monitoring and powering the seat's side-to-side movement. The base unit's control panel provides controls for turning the swinging on, off, providing for various levels of speed or amplitude control, as well as an option for maintaining the unit in a stationary position. The user-operable controls are interfaced with an actuator control circuit that is designed to derive linear actuator 45 (FIG. 10). The bottom of the base unit is equipped with tactile rubber padding for additional stability.

FIG. 13 illustrates baby monitor 33 situated in base support unit 20. In one embodiment, monitor 33 includes a microphone and an RF transmitter circuit. A portable receiver 80 adapted to receive transmitted signals from monitor 33 can be carried by the parents or baby's caregiver to other rooms of the home.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed is:

1. An infant holder apparatus, comprising:

a support structure that includes a base support and a head support situated at opposing longitudinal ends and mutually coupled by a longitudinal stabilizer; and a seat adjustable between a lying position and a sitting position, wherein the seat has a base end that is suspended from the base support and a head end that is suspended from the head support and wherein at least one of the base and head ends is suspended by at least one flexible line, wherein at least one of the base support and head support is adjustable between a first rigid position and a second rigid position to facilitate adjustment between the lying and sitting positions.

2. The infant holder apparatus of claim 1, wherein the at least one of the base support and head support is fixable at an intermediate third rigid position between the first and second positions.

3. The infant holder apparatus of claim 1, wherein the base end and the head end of the seat are each suspended by a set of three cables.

4. The infant holder apparatus of claim 1, wherein the base end and the head end of the seat are each suspended from their respective support such that the seat is laterally movable.

5. The infant holder apparatus of claim 4, and further comprising:

a locking mechanism to retain the seat in a fixed position such that the seat is prevented from laterally moving.

6. The infant holder apparatus of claim 4, and further comprising:

a swing actuating mechanism adapted to apply force to maintain lateral movement of the seat.

7. The infant holder apparatus of claim 1, and further comprising:

a teether coupled to the seat via a self-retracting teether.

8. The infant holder apparatus of claim 1, and further comprising:

a baby monitor that includes a microphone and a wireless transmitter.

9. An infant holder apparatus, comprising:

a support structure that includes a base support and a head support situated at opposing longitudinal ends and mutually coupled by a longitudinal stabilizer;

a seat having a base end suspended from the base support and a head end suspended from the head support, wherein the seat is adjustable between a lying position and a sitting position;

and wherein at least one of the base and head supports includes a joint adapted to pivot between a first fixed position and a second fixed position corresponding to the lying position and the sitting position.

10. The infant holder apparatus of claim 9, wherein the seat includes a first rigid portion coupled with a second rigid portion by at least one pivotable coupling that facilitates adjustment between the lying and sitting positions.

11. The infant holder apparatus of claim 9, wherein the seat includes a seat frame that supports a fabric cover.

12. The infant holder apparatus of claim 11, wherein the fabric cover is formed from a web of an elastic material.

13. The infant holder apparatus of claim 9, wherein the seat includes a user-operable unlock mechanism for unfixing the at least one of the base and head supports to facilitate movement between the first and second fixed positions.

14. The infant holder apparatus of claim 9, wherein the base end and the head end of the seat are each suspended from their respective support such that the seat is laterally movable.

15. The infant holder apparatus of claim 14, and further comprising:

a swing actuating mechanism adapted to apply linear force to maintain swinging motion of the seat.

16. An infant holder apparatus, comprising:

a base that includes a first support and a second support situated along a first axis at opposing longitudinal ends;

a seat having a first end coupled with the first support and a second end coupled with the second support; and a swing system that includes linear actuator configured to facilitate lateral swinging of the seat, wherein the linear actuator includes a stator electromagnetically coupled with a slider and situated to apply force in at least one direction that is generally perpendicular to the first axis.

17. The infant holder apparatus of claim 16, wherein the slider includes an arcuate rod situated such that the rod's curvature matches a swing trajectory of the seat at the rod's position.

18. The infant holder apparatus of claim 16, wherein the stator at least partially circumscribes the slider about the slider's axis of motion.

19. The infant holder apparatus of claim 16, wherein the actuator is adapted to apply a first force in a first direction and to apply a second force in a second direction opposite the first direction.

20. The infant holder apparatus of claim 16, wherein the stator is fixed to the base and the slider is fixed to the seat.

21. The infant holder apparatus of claim 16, wherein the swing system includes a controller circuit that is electrically coupled with the actuator and adapted to drive the actuator.

22. The infant holder apparatus of claim 21, wherein the controller is adapted to drive the actuator to control at least one of an amplitude, a frequency or a velocity of the swinging of the seat.

23. The infant holder apparatus of claim 16, wherein at least one of the first and second supports includes a joint adapted to pivot respectively between a first fixed position and a second fixed position corresponding to an inclined lying position of the seat and an upright sitting position of the seat.

24. The infant holder apparatus of claim 16, and further comprising:

a locking mechanism adapted to retain the seat in a fixed position such that the seat is prevented from swinging freely.

* * * * *